US005441383A

United States Patent [19]

Dale et al.

[11] Patent Number: 5,441,383

[45] Date of Patent: Aug. 15, 1995

[54] VARIABLE EXHAUST DRIVEN TURBOCHARGERS

[75] Inventors: Adrian P. Dale, Reading; David Flaxington, Formby; Andrew R. S. McCutcheon, Maidenhead, all of Great Britain

[73] Assignee: AlliedSignal Inc., Morris Township, Morris County, N.J.

[21] Appl. No.: 64,534

[22] Filed: May 19, 1993

[30] Foreign Application Priority Data

May 21, 1992 [GB] United Kingdom ..... 9210892
Jul. 2, 1992 [GB] United Kingdom ..... 9214085

[51] Int. Cl.[6] ..... F01D 17/14

[52] U.S. Cl. ..... 415/158; 415/150; 415/165

[58] Field of Search ..... 415/150, 157, 158, 165

[56] References Cited

U.S. PATENT DOCUMENTS 2,996,996 8/1961 Jassniker .
3,079,127 2/1965 Rowlett et al. .
4,403,914 9/1983 Rogo et al. ..... 415/165

FOREIGN PATENT DOCUMENTS 0342889 11/1989 European Pat. Off. .
2359973 2/1978 France .
1264675 11/1965 Germany .
668455 12/1988 Switzerland .
1138941 1/1969 United Kingdom .
8911583 11/1989 WIPO .

*Primary Examiner*—Edward K. Look
*Assistant Examiner*—Michael S. Lee
*Attorney, Agent, or Firm*—Larry J. Palguta

[57] ABSTRACT

A variable inlet nozzle exhaust-driven turbocharger comprises a compressor (2, 5, 6) driven via a main shaft (8) by a turbine wheel (10, 11) subject to engine exhaust gas flow through an annular nozzle formed between a heat shroud (21) having slots (22) to receive vanes (17) carried by a sleeve axially movable in the exhaust duct (19) downstream of the turbine wheel the sleeve being actuable by means acting via a space (25) defined between bearing parts of the sleeve and the part of the turbine housing carrying the exhaust duct bore (19) being of uniform annular section to minimize thermal effects.

9 Claims, 5 Drawing Sheets

VARIABLE EXHAUST DRIVEN TURBOCHARGERS

Figure 1:
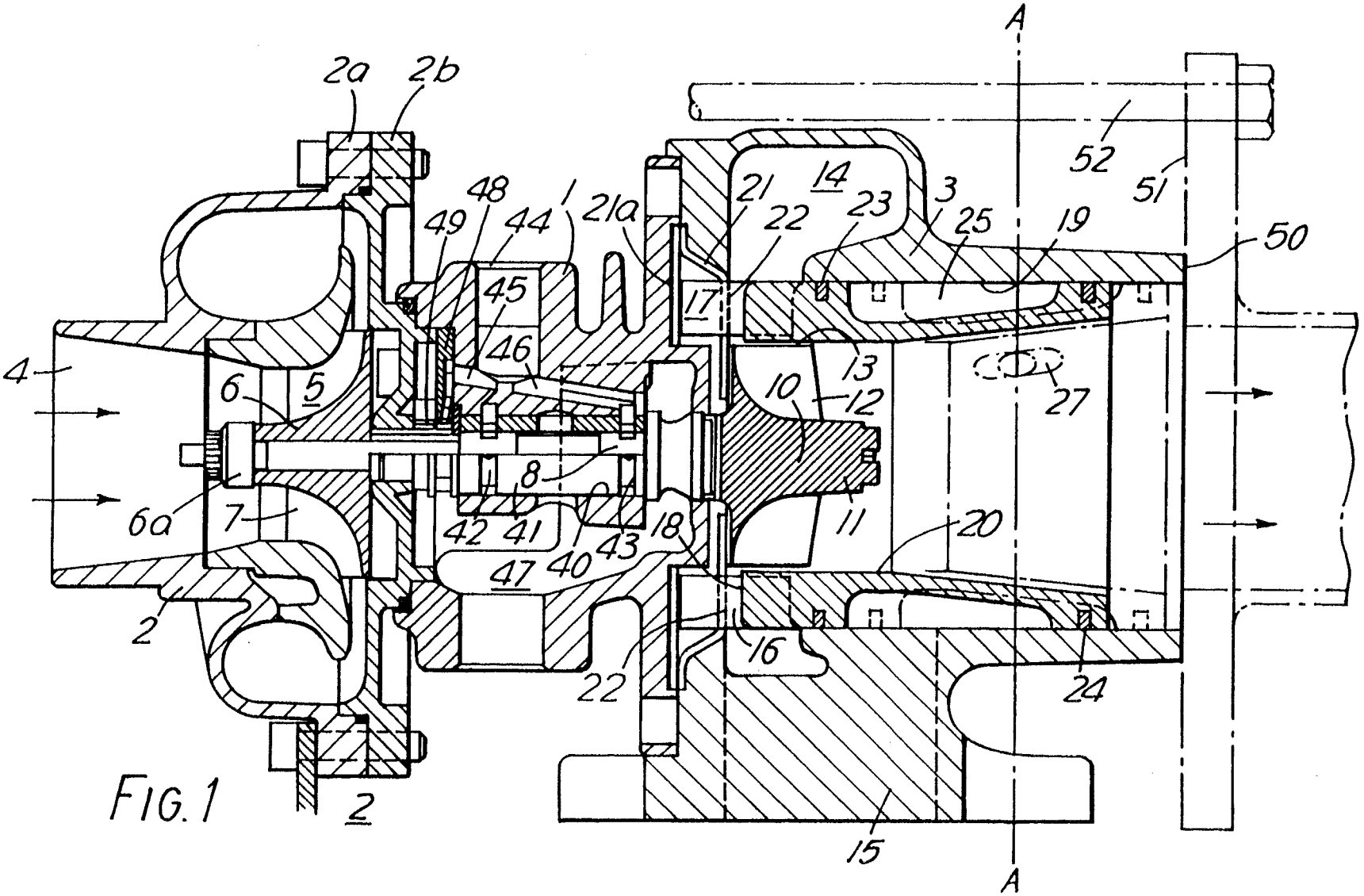

This invention relates to variable exhaust driven turbochargers particularly of a type which comprises a turbine housing within which a turbine wheel is rotatably supported to be driven by engine exhaust gas impinging thereon, to drive a compressor impeller.

Variable exhaust-driven turbochargers have already been proposed which include a turbine wheel rotatably supported in a turbine housing to be rotatable by engine exhaust gas ducted thereto via an annular nozzle. Such nozzle has included vanes other than radially angled to provide advantageous gas flow geometry and the effective axial nozzle passage width has been proposed to be variable by means which moves the vanes axially or alternatively by means which moves a heat shroud over the vanes or alternatively varies the angle of the vanes. Such turbochargers have usually comprised a central housing carrying bearing means for a common shaft which supports the turbine wheel in its housing at one end and supports the compressor impeller in its compressor housing at the other end. The central housing has also contained means for movably supporting the vanes or the heat shroud and actuating means for moving same to vary the turbine nozzle geometry. Such a construction has resulted in a relatively complex center housing although it has had the effect of keeping such movable parts away from the immediate area of the turbine housing which is subject to extreme thermal cycling.

In the Specification of European Patent Application No. 0093462 an exhaust gas driven turbocharger has been described in which a turbine nozzle ring is provided with a plurality of spaced fixed guide vanes in the turbine housing and extending between side walls of the nozzle. Downstream of these vanes a generally cylindrical slide ring is slideably carried in the downstream bore to move axially whilst being in close proximity with the innermost or downstream edges of the guide vanes and with the generally cylindrical periphery of a turbine wheel. Adjustment of the effective input geometry is achieved by axial movement of the slide ring inwardly or outwardly of the turbocharger casing although it is considered that an unsatisfactory inlet exhaust gas flow path will result from such an arrangement.

The object of the present invention is to provide a variable exhaust-driven turbocharger affording simpler construction and control actuation than hitherto, particularly for the center housing and to give improved gas flow.

According to the present invention there is provided a variable exhaust driven turbocharger comprising a compressor impeller mounted on a shaft rotatable in a compressor housing said shaft being driveably connected to a turbine wheel rotatable in a turbine housing, said turbine housing having an inlet nozzle for receiving exhaust gases from an engine and being shaped to conduct such gases to impinge upstream edges of blades of said turbine wheel, said nozzle having axially spaced side walls extending about said upstream edges of the turbine wheel and having axially extending spaced and angled vanes traversing the space defined between the side walls and wherein one said side wall is carried by an axially movable sleeve slideably carried in a bore of the housing downstream of the turbine wheel and said bore having at least one elongate aperture via which actuating means communicates with the sleeve from outside the housing to axially move the sleeve to vary the geometry of said nozzle.

Figure 2:
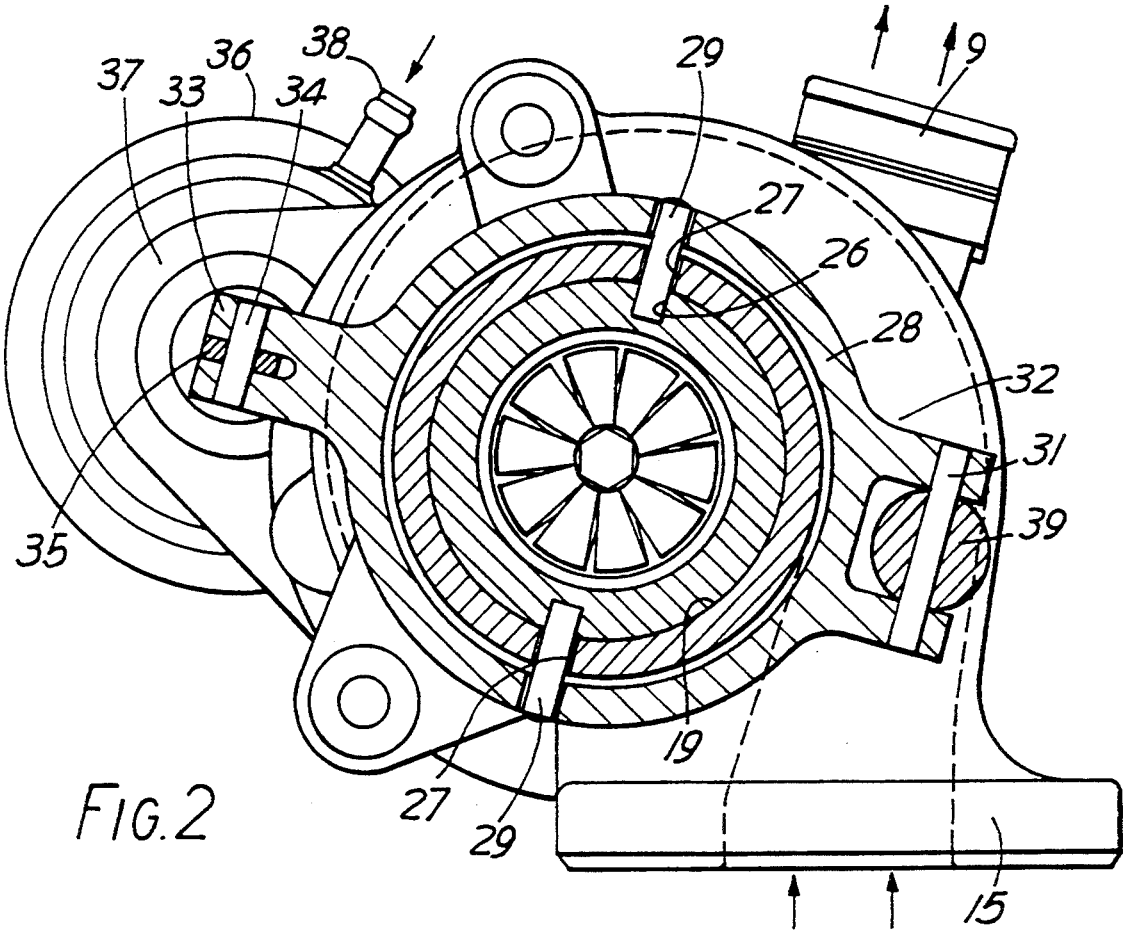

In order that the invention may be more clearly understood and readily carried into effect the same will now be further described by way of an example with reference to the accompanying drawings of which FIG. 1, illustrates a section taken through the axis of a turbocharger employing the invention FIG. 2, illustrates a transverse sectional view on the line AA of FIG. 1.

Figure 4:
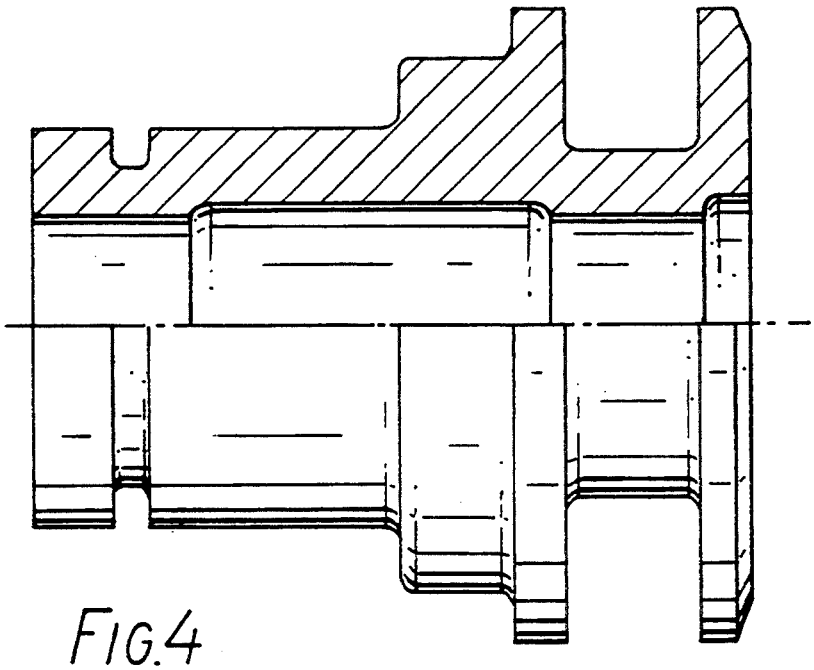
Figure 3A:
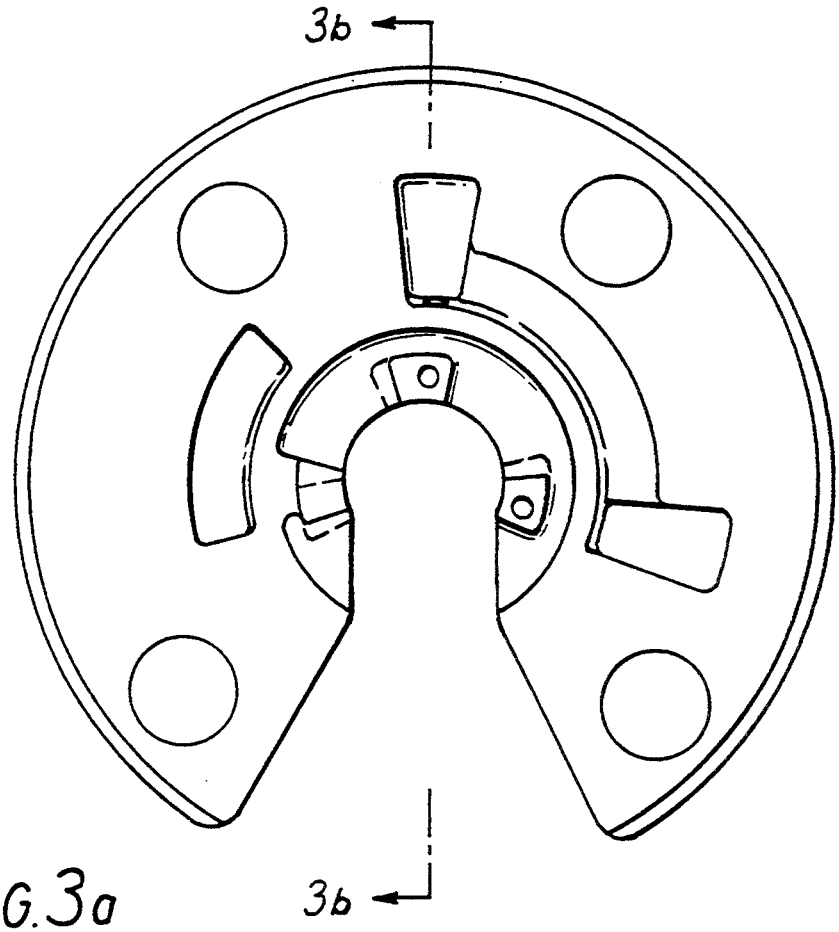
Figure 3B:
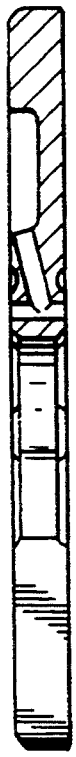
Figure 5:
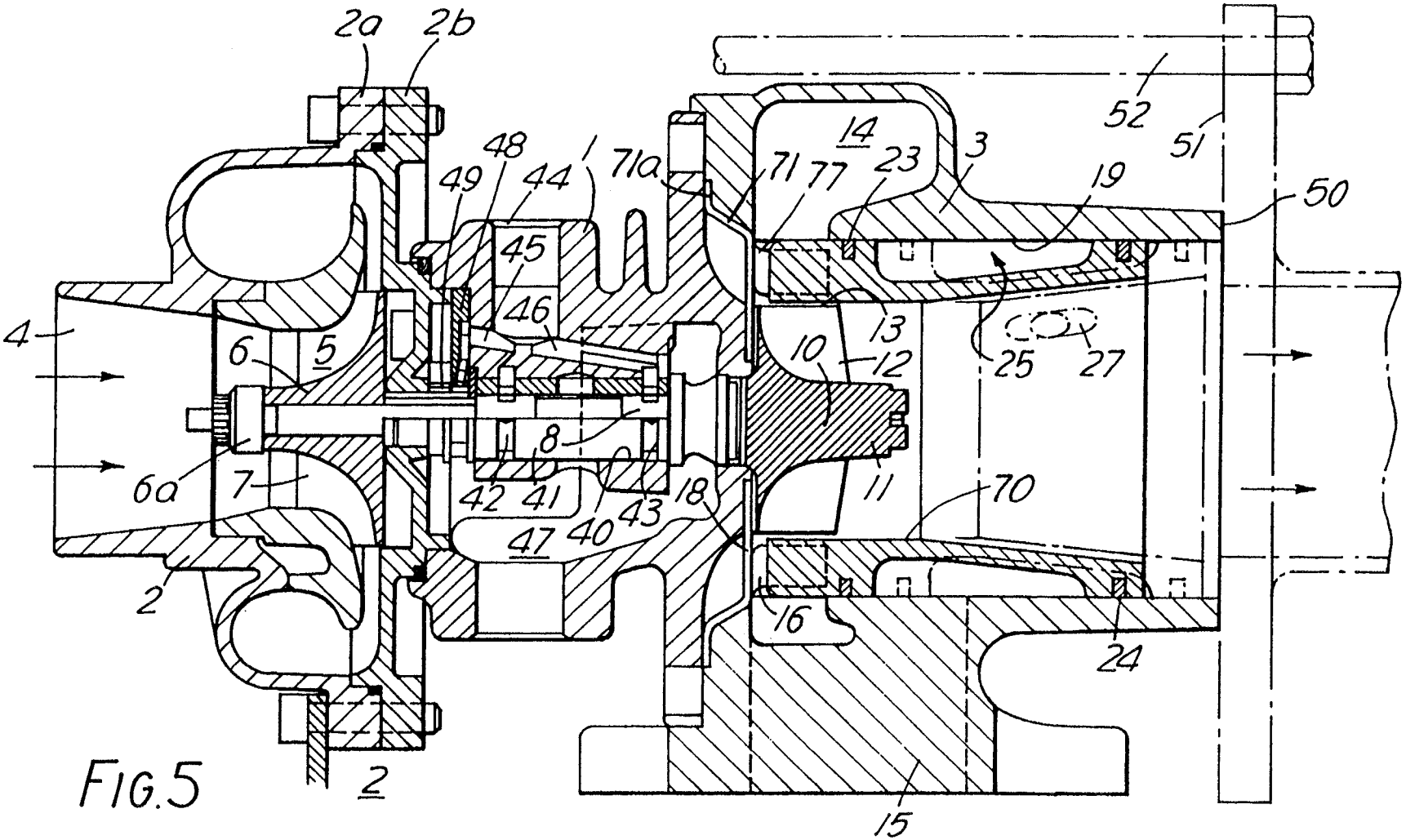
Figure 6A:
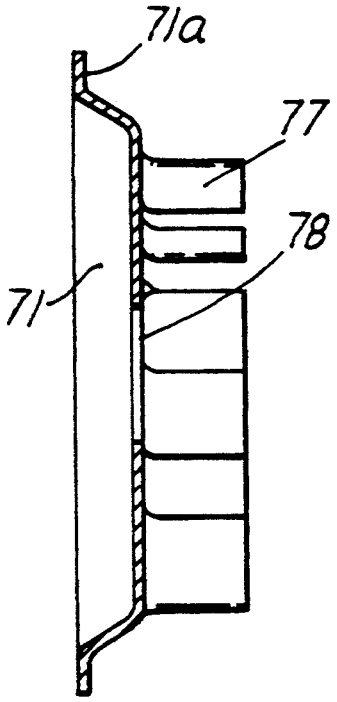
Figure 6B:
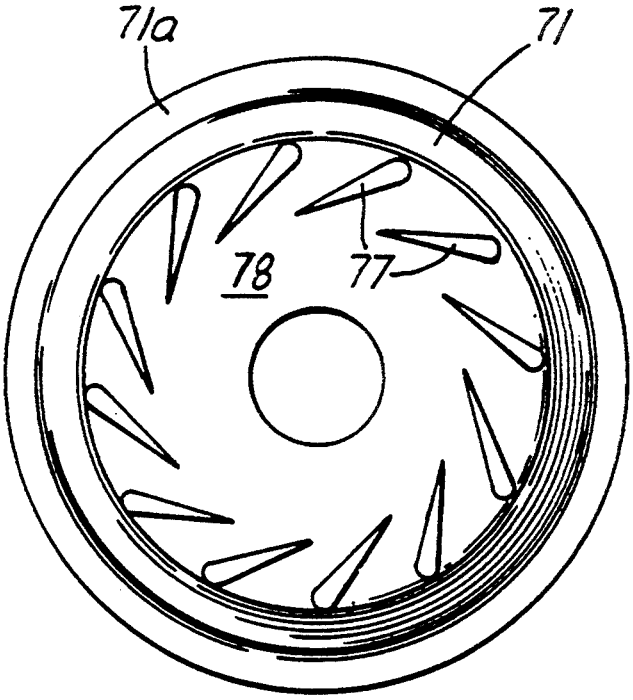
Figure 7A:
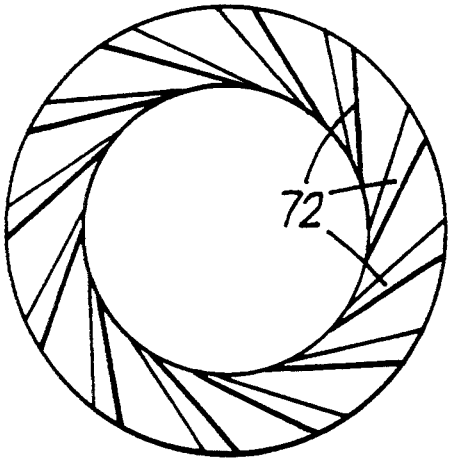
Figure 7B:
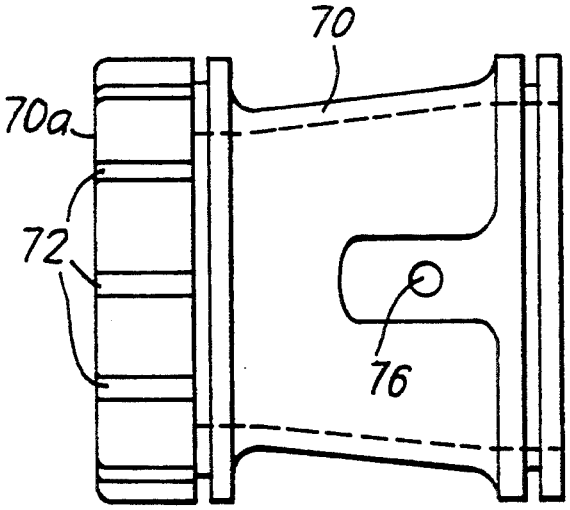

FIG. 3*a* and FIG. 3*b*, show plan and sectioned views of a thrust bearing FIG. 4, shows a part-sectional view of a thrust collar FIG. 5, illustrates a section taken through the axis of an alternative turbocharger employing the invention FIGS. 6*a* and 6*b*, illustrate side and end views of a heat shield carrying nozzle vanes of the turbocharger of FIG. 5 and FIGS. 7*a* and 7*b*, illustrate side and end views of an axially movable sleeve member of the turbocharger of FIG. 5.

Referring to FIG. 1, the exhaust-driven turbocharger comprises a housing assembly including a center housing 1 which contains a main bearing as further described later. Attached to the housing at the left and right hand ends as shown in FIG. 1 there is a two-part compressor housing 2 and a turbine housing 3 respectively. The compressor housing is formed with an atmospheric air inlet duct 4 communicating in an axial direction with the outer end of a compressor impeller 5 having a shaped hub 6 fixedly attached to a turbocharger main shaft and blades 7, of generally known form, shaped to closely match the interior of housing. Rotation causes induced air at duct 4 to be compressed in a reducing-section scroll-shaped cavity formed in part 2*a* to emerge at an elevated pressure at a delivery port 9 (FIG. 2).

The compressor impeller 5 is driven via the turbocharger main shaft 8 by an exhaust-gas-driven turbine wheel 10 formed integrally with the shaft 8. The turbine wheel comprises a shaped hub 11 and turbine blades 12 carried thereby. The blades 12 have a generally cylindrical gas receiving edge profile 13 and are shaped to receive exhaust gas radially inwards via a scroll-shaped turbine chamber 14 from an engine manifold mounting flange 15, the exhaust gas being emitted axially from the turbine wheel 10 into the exhaust pipe 51.

The gas flow from the scroll-shaped chamber 14 is via a variable geometry annular turbine nozzle 16, the nozzle 16 being defined in an annular region of the turbine housing which is traversed axially by shaped and angled spaced nozzle vanes 17. These vanes are each mutually equally spaced and angled away from respective radii and extend across an axially variable annular space defined between the annular side walls of the annular nozzle. The nozzle geometry is therefore variable by adjusting the spacing between these annular side walls. In the present example there are twelve such vanes 17 having cross sectional shape similar to the vanes 57 referred to later with reference to FIGS. 6*a* and 6*b*. In the present example vanes 17 are carried by one wall, namely the inner end wall 18 of a generally cylindrical sleeve member 20 which is axially slideable within the bore 19 of the turbine housing part 3. The other side wall of the variable geometry nozzle is provided by a fixed sheet-metal heat shroud 21 which is formed of a generally dish shape and has equally spaced and angled slots 22 to closely receive the angled and axially moving vanes 17. The heat shroud 21 is provided with a further annular dish shaped part 21*a*, the shroud parts 21 and 21*a* being mutually sealed together to form a gas-tight annular enclosure the only gas connection to which is via any clearance around vanes 17 in slots 22. The length of the turbine nozzle is thereby increased by rightward movement of the member 20 towards a position shown in broken lines in FIG. 1.

The cylindrical member 20 is operated by a control system and provided with spaced peripheral bearing rings 23, 24 of suitably compatible material with bore 19 and located in annular grooves at the vicinities of the respective ends and these bearing rings define a closed annular, region 25 between member 20 and the surrounding bore. As seen in FIG. 2, the member 20 is provided with radially inward drillings 26 to retainably receive two press-fitted control pins 29, or any suitable connecting member which are able to project through the turbine housing 3 via two diametrically opposed and axially elongate apertures such as 27, for engagement with a control yoke 28 or any suitable collective actuating member. The apertures 27 are always between the bearing rings 23 and 24 whereby the pins and apertures are effectively isolated from the hot gases. The yoke 28 is generally annular in shape and of such relatively large internal diameter as to freely pass around the external diameter of the outlet duct of the turbine housing 3, whilst also permitting tilting movement about a pivot pin 31 of a projection 32 at one end supported by the housing at 39. The diametrically opposed other end 33 of yoke 28 has a further projection 33, making pivotal connection to an actuator rod 35 via a pivot pin 34.

An actuator rod 35 is provided which comprises an actuator output rod of a pneumatic actuator 36 (seen in end view of FIG. 2) carried on an integral bracket 37 of the turbocharger housing, The output rod 35 lies approximately parallel to the axis of the turbocharger shaft 8 and typically the output rod is movable by an internal diaphragm (not shown) in response to super atmospheric air pressure applied to an input pipe 38. This the mechanism operates in the sense that increased control pressure at pipe 38 of the pneumatic actuator 36 causes the output rod to move axially outwards of the actuator (FIG. 2) pivoting the yoke 28 about pivot pin 31. Such movement carries pins 29 and therefore sleeve 201 in the same direction in bore 19 to increase the length of the space between the annular side walls 18, 21 of the turbine nozzle.

The turbine housing 3 and the turbine 10 are manufactured as castings of castable stainless steel, typically being a mixture of ostenitic and ferritic stainless steels chosen for combined properties which are suitable for such turbocharger application. The turbine wheel 10 is a high cobalt high nickel steel which has high centrifugal stress properties at the elevated temperatures which prevail and it also expands less than the surrounding sleeve 20.

In order to minimize non-uniform areas of thermal expansion and contraction in the turbine housing 3, the portion of that housing which contains the bore 19 has substantially uniform annular section over a major part of its length, although the thickness progressively slightly reduces in the downstream direction towards an annular end surface 50 which abuts an exhaust pipe coupling flange such as shown in broken lines at 51. The flange 51 is bolted axially via bolts, such as 52 to three (not shown) projections from the center housing spaced around the turbine housing to allow free flow of air around the latter and to direct the induced stresses due to the exhaust pipe into the housing 3, away from the central bore 19.

Reverting again to the center housing 1 and the turbocharger bearing, the housing 1 is provided with a bore 40 which receives a phosphor-bronze bearing bush 41 within which the main shaft 8 rotates with predetermined diametral clearance at respective bearing portions 42 and 43 which are fed with lubricant under pressure from a port 44 via passages 45 and 46. The portion of the housing which carries the main shaft is also surrounded by a draining region 47 which oil emanating from the pressurised bearing portions 42 and 43 is free to drain away back to the oil sump (not shown) for recirculation.

Assembly of the turbocharger is as follows. The turbine wheel with its integral main shaft is first assembled to the center housing together with the bearing bush 41 and the heat shroud 21. A thrust bearing 48 seen on enlarged scale plan and section views in FIGS. 3*a* and 3*b* including suitable oil ways, and a cooperating collar 49 to be seen in further enlarged part-sectional view in FIG. 4, are also then placed in position in the housing and located on the shaft before bolting the plate 2*b* onto the center housing whilst retaining the shaft 8 in position.

The heat shroud 21,22 is then positioned. The compressor impeller 5 is then placed in position and locked to the shaft by means of a nut 6*a* before attaching the induction portion 2*b* of the compressor housing. The turbine housing is then assembled with its sleeve member 20, the heat shroud 21 being in position on the center housing to receive the vanes 17 and the pins 29 then being inserted by press fitting and housing 3 is finally attached to the center housing by means of three mounting studs (not shown). The yoke 28 is then positioned by means of pin 31 and pins 29 are inserted through clearance holes in yoke 28 and slots 27. Pins 29, being a press fit in the diametral holes in sleeve 20, are self retaining. Pivot pin 34 is then inserted to connect and complete the actuator mechanism.

In an alternative construction, the yoke 28 of FIG. 2 may be comprised of two metal pressings between which the actuating pins 29 are trapped when the two pressings are brought together and located on pins 31 and 34.

In operation of the variable nozzle turbocharger, when mounted to an internal combustion engine, exhaust gases flow from the engine exhaust manifold via flange 15 into the larger end of the scroll-formed turbine chamber 14 to impinge on the turbine wheel 10, 12 via the annular nozzle formed between walls 18 and 21. The gas flow through the nozzle is aerodynamically ordered via the axially extending and angled vanes 17, resulting in rotation of the turbine wheel and the compressor impeller 5, 6 to increase the pressure induced thereby with the induction manifold of the engine. Since the vanes 17 project with a close fit through the slots 22 into an enclosed annular chamber, loss of efficiency due to gas flow through slots 22 is minimized. The pneumatic actuator 36 is supplied with a pressure signal at 38 which in general varies with the loading on the engine in a sense to move the sleeve 20 in a rightward direction as seen in FIG. 1 to increase the effective length of the variable geometry nozzle for increased engine loading. The turbocharger control program is thereby designable to enable desired resultant compressor air pressure at 38 to be maintained substantially independently of engine speed.

In the alternative exhaust-gas-driven turbocharger which is illustrated in FIG. 5, the constructional features of the housing and the compressors and turbine wheel are largely the same as in the turbocharger of FIGS. 1 and 2. However, the heat shield 21, 22 of FIG. 1 is now replaced by a modified heat shield 71 as shown on a larger scale in FIGS. *6a* and *6b*. Heat shield 71 carries axially extending input nozzle vanes 77 which are equally spaced and angled relative to the radii of the shield 71. These vanes are further received by correspondingly closely shaped complementary slots or recesses 74 as seen in the end view of FIGS. *7a* and *7b* of a modified form of axially movable sleeve 70, the latter being movable within the bore 19 as before. As seen in FIGS. *7a* and *7b*, the angled slots or recesses 74, the flanks of which closely receive the flanks of vanes 77 are open at their ends. That is, these slots break out at the inner and outer cylindrical surfaces of the modified piston 70. Otherwise, the piston 70 is generally the same as piston 20 of FIG. 1 and is similarly axially movable via a control yoke 28 and pins 26.

Although in the examples of turbochargers described, the variable input nozzles have twelve angled vanes, a larger number of such vanes may advantageously be employed for an optimal gas flow configuration.

We claim:

1. A variable exhaust-driven turbocharger, comprising a compressor impeller mounted on a shaft for rotation in a compressor housing, said shaft being driveably connected to a turbine wheel rotatable in a turbine housing, said turbine housing having an inlet nozzle for receiving exhaust gases from an engine and being shaped to conduct such gases to impinge upstream edges of blades of said turbine wheel, said nozzle having axially spaced-apart side walls extending circumferentially about said upstream edges of the turbine wheel and having axially extending spaced-apart and angled vanes traversing an annular space defined between the side walls wherein one said side wall is fixed and the other said side wall is carried by one end of a sleeve slideably carried to be moveable in an axial direction in a bore of the turbine housing extending downstream of the turbine wheel, said turbine housing having at least one through aperture, and a control system comprising a connecting member in said bore and connected with the sleeve from outside the turbine housing by means of a collective actuating member, and axially movable in said through aperture in said axial direction to move axially the sleeve to vary the geometry of said nozzle.

2. The variable exhaust-driven turbocharger as claimed in claim 1, wherein said spaced-apart and angled vanes are carried by said one side wall and extend axially into slots or recesses formed in the other side wall.

3. The variable exhaust-driven turbocharger as claimed in claim 1, wherein one side wall has angled slots or recesses which receive said vanes, said vanes being carried by said other side wall.

4. The variable exhaust-driven turbocharger as claimed in claim 1, 2 or 3, wherein said axially movable sleeve has external bearing portions at or near each end providing sliding engagement with said bore, said portions being separated by a reduced diameter region defining an annular space in which said actuating means acts on said sleeve.

5. The variable turbocharger as claimed in claim 4, wherein said bearing portions are provided by piston-rings slideable in said bore.

6. The variable exhaust-driven turbocharger as claimed in claim 1, 2 or 3, wherein said turbine housing comprises a pair of apertures, and said actuating means includes one or more studs which extend radially outwardly from said annular space through the respective apertures in said turbine housing.

7. The variable exhaust-driven turbocharger as claimed in claim 1, wherein said control system includes a yoke which extends at least partially around the exterior of the turbine housing containing said bore and actuation of said sleeve being by pivotal movement of said yoke about a pivot point fixed relative to the housing.

8. The variable exhaust-driven turbocharger as claimed in claim 7, wherein said yoke comprises two joined metal pressings between which actuating pins or studs for said sleeve are trapped.

9. The variable exhaust-driven turbocharger as claimed in claim 1, wherein the turbine housing is of substantially uniform annular section to minimize non-uniform thermal expansion and contraction thereof.

* * * * *